US011396708B2

(12) United States Patent
Snyder et al.

(10) Patent No.: US 11,396,708 B2
(45) Date of Patent: Jul. 26, 2022

(54) WATER SOLUBLE METALWORKING CONCENTRATE

(71) Applicant: Master Chemical Corporation, Perrysburg, OH (US)

(72) Inventors: Joseph Alan Snyder, Maumee, OH (US); Chandrashekhar Sadanand Khadilkar, Broadview Heights, OH (US)

(73) Assignee: Master Chemical Corporation, Perrysburg, OH (US)

( * ) Notice: Subject to any disclaimer, the term of this patent is extended or adjusted under 35 U.S.C. 154(b) by 125 days.

(21) Appl. No.: 16/553,935

(22) Filed: Aug. 28, 2019

(65) Prior Publication Data

US 2020/0115805 A1 Apr. 16, 2020

Related U.S. Application Data

(60) Provisional application No. 62/744,364, filed on Oct. 11, 2018.

(51) Int. Cl.

| | |
|---|---|
| ***C23F 11/167*** | (2006.01) |
| ***C23F 11/12*** | (2006.01) |
| ***C23F 11/14*** | (2006.01) |

(52) U.S. Cl.

CPC ..... *C23F 11/1673* (2013.01); *C23F 11/124* (2013.01); *C23F 11/141* (2013.01)

(58) Field of Classification Search

CPC ... C23F 11/1673; C23F 11/124; C23F 11/141; C23F 11/10; C10N 2030/16; C10N 2030/12; C10N 2030/64; C10N 2030/18; C10N 2030/24; C10N 2040/20; C10N 2070/02; C10N 2020/091; C10M 2223/02; C10M 2207/122; C10M 2205/16; C10M 2219/044; C10M 2207/402;

(Continued)

(56) References Cited

U.S. PATENT DOCUMENTS

| | | | |
|---|---|---|---|
| 3,933,658 A | 1/1976 | Beiswanger et al. | |
| 4,654,155 A | 3/1987 | Kipp et al. | |

(Continued)

FOREIGN PATENT DOCUMENTS

| | | | | |
|---|---|---|---|---|
| KR | 100645098 B1 * | 11/2006 | | |
| WO | 9302164 A1 | 2/1993 | | |
| WO | WO-2004037960 A1 * | 5/2004 | ..... | C10M 173/02 |

OTHER PUBLICATIONS

"Metalworking Additives", Kao Chemicals, (May 31, 2018), URL: https://www.kaochemicals-eu.com/sites/default/files/related_files/business_unit/Metalworking_Additives_Brochure.pdf, (Nov. 26, 2019), XP055702750 [A] 1-20.

*Primary Examiner* — Pamela H Weiss

(74) *Attorney, Agent, or Firm* — Vivacqua Crane PLLC

(57) ABSTRACT

A water soluble metalworking concentrate is a combination of one or more amines; one or more ferrous corrosion inhibitors; one or more phosphate esters; one or more ether carboxylates; a ricinoleic acid condensate; one or more lubricating agents; deionized water and, optionally, one or more non-ferrous corrosion inhibitors. In use, the concentrate is diluted to a concentration of approximately 5% to approximately 10%. In use, the metalworking fluid exhibits excellent lubricity, low foam generation, emulsion stability, protection of ferrous and non-ferrous metals, biostatic stability and environmental compatibility.

9 Claims, 1 Drawing Sheet

(58) Field of Classification Search
CPC ..... C10M 2229/02; C10M 2215/044; C10M 2209/104; C10M 2207/40; C10M 2223/04; C10M 2209/082; C10M 2207/123; C10M 2215/222; C10M 2215/223; C10M 2215/042; C10M 2201/02; C10M 173/02; C10M 2209/103
See application file for complete search history.

(56) References Cited

U.S. PATENT DOCUMENTS

| | | | | |
|---|---|---|---|---|
| 6,413,917 | B1 * | 7/2002 | Yamada | C10M 135/02 508/324 |
| 6,592,775 | B1 | 7/2003 | Skold | |
| 9,029,306 | B2 | 5/2015 | Takagi et al. | |
| 9,605,232 | B2 * | 3/2017 | Takagi | C10M 173/00 |
| 2008/0171680 | A1 * | 7/2008 | Kim | C10M 109/00 508/491 |
| 2008/0176778 | A1 * | 7/2008 | Seemeyer | B65G 45/10 508/433 |
| 2014/0128299 | A1 * | 5/2014 | Zhao | C10M 173/02 508/280 |
| 2015/0064741 | A1 * | 3/2015 | Gibbons | G01N 33/2888 435/34 |
| 2015/0299599 | A1 * | 10/2015 | Takagi | C10M 173/00 508/503 |
| 2016/0102268 | A1 | 4/2016 | Garcia | |

* cited by examiner

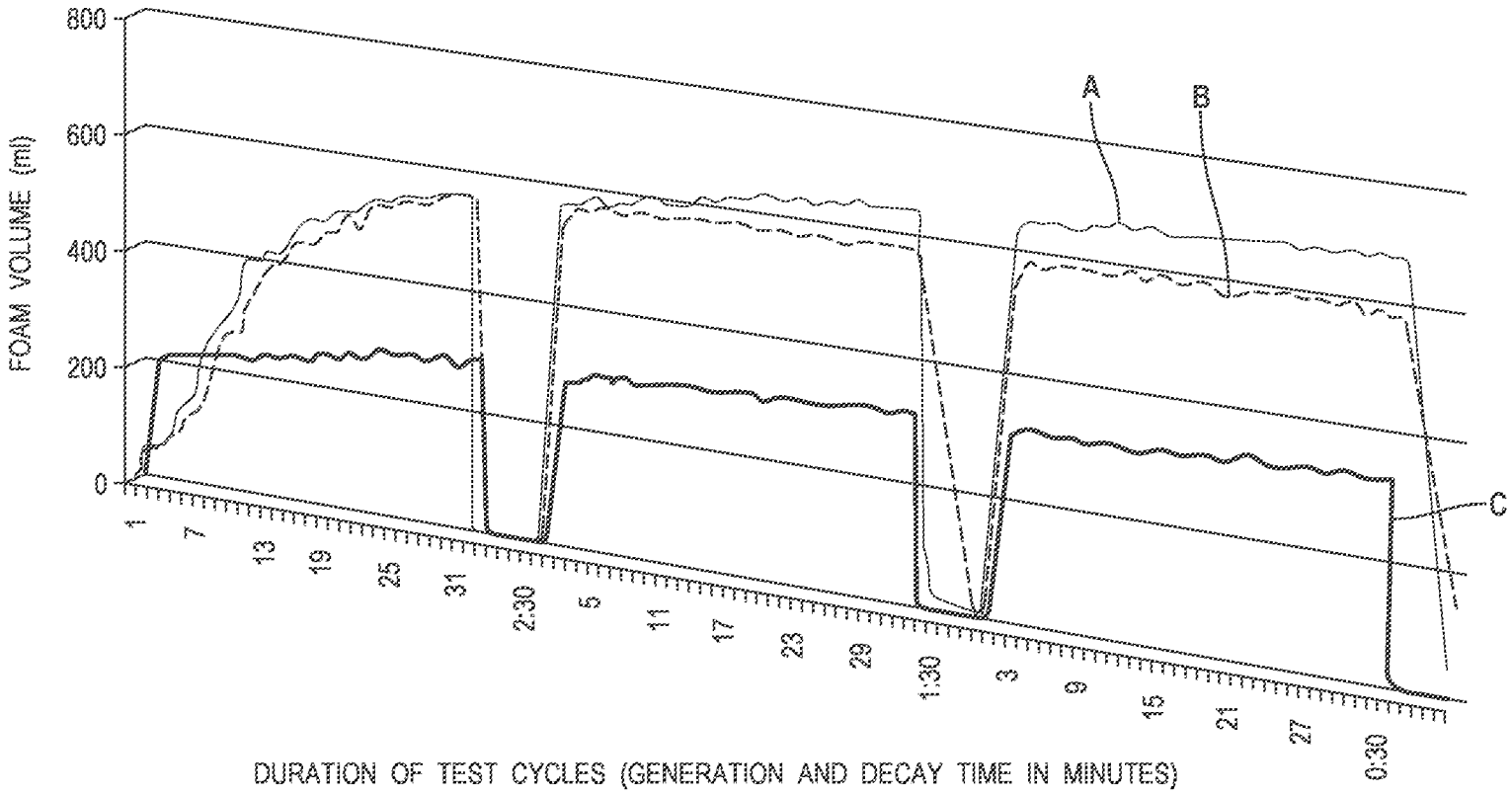
FOAM VOLUME (ml)
800
600
400
200
0
A
B
C
1
7
13
19
25
31
2:30
5
11
17
23
29
1:30
3
9
15
21
27
0:30
DURATION OF TEST CYCLES (GENERATION AND DECAY TIME IN MINUTES)

WATER SOLUBLE METALWORKING CONCENTRATE

CROSS REFERENCE TO RELATED APPLICATION

This application claims the benefit of U.S. Provisional Patent Application Ser. No. 62/744,364, filed Oct. 11, 2018, which is hereby incorporated herein by reference in its entirety.

FIELD

The present disclosure relates to a formulation of a water soluble metalworking concentrate capable of performing the multiple functions required of such fluids. More particularly, the water soluble metalworking concentrate is a combination of several constituents and deionized water which can be further diluted with deionized, reverse osmosis or tap water.

BACKGROUND

The metalworking industry has long had difficulty machining hard materials. Hard metal materials are described as alloys of steels, alloys of stainless steel, alloys of nickel, alloys of titanium, and other high temperature alloys. Additionally, in certain industries such as the aerospace industry, novel materials such as ceramic metal composites (CMC's) are emerging as the materials of choice for critical applications. The difficulties encountered in machining these materials typically involve lack of lubricity and resultant decreased machine tool life, lack of appropriate surface finish, and an inability to maintain critical machining tolerances due to lack of insufficient cooling capacity.

In order to assist in these machining operations, certain additives are often utilized to provide certain desirable characteristics, such as additional lubricity, while maintaining the other key characteristics of a metalworking fluid such as low foam, biostatic control and machine and substrate corrosion protection. These additives typically involve the use of materials that contain chlorine, sulfur and/or boron in some combination. From the point of view of cost, regulatory compliance, and functional performance, it is preferred that these typical additives are either minimized or eliminated. Thus, a typical engineering conundrum prevails: the materials which significantly assist achievement of desired or necessary operating parameters are the same materials that are either undesirable or problematic from other points of view.

BRIEF SUMMARY

This present invention does not utilize these materials while matching or exceeding the lubricity that they provided to the formulation and maintaining and improving on the other functional characteristics of the fluid including biological control, emulsion stability, foam control, water solubility, low impact to human skin and membranes, and lack of corrosion on ferrous and non-ferrous materials. Specifically, the present invention provides a metalworking concentrate which is a combination of one or more amines; one or more ferrous corrosion inhibitors; one or more phosphate esters; one or more ether carboxylates; a ricinoleic acid condensate; one or more lubricating agents; and deionized water. One or more non-ferrous corrosion inhibitors is an additional and optional constituent.

These six constituents (seven including deionized water and eight including one or more non-ferrous corrosion inhibitors) may be present in varying concentrations as will be described below. The majority of the water soluble metalworking concentrate of the present invention is deionized water and, at the consumption site, the concentrate may be further diluted with deionized, reverse osmosis or tap water.

Thus it is an aspect of the present invention to provide a metalworking concentrate which is a combination of at least one amine, at least one ferrous corrosion inhibitor, at least one phosphate ester, at least one ether carboxylate, a ricinoleic acid condensate, at least one lubricating agent, deionized water and, optionally, at least one non-ferrous corrosion inhibitor.

It is a further aspect of the present invention to provide a metalworking concentrate which is a combination of one or more amines, one or more ferrous corrosion inhibitors, one or more phosphate esters, one or more ether carboxylates, a ricinoleic acid condensate, one or more lubricating agents, deionized water and, optionally, one or more non-ferrous corrosion inhibitors.

It is a still further aspect of the present invention to achieve the lubricity of prior art metalworking fluids that contain chlorine and/or chlorine containing compounds, sulfur and/or sulfur containing compounds and boron and/or boron containing compounds.

It is a further aspect of the present invention to achieve a low foam metalworking fluid with or without the use of traditional antifoam or defoamer constituents.

It is a still further aspect of the present invention to achieve non-staining compatibility with a variety of aluminum alloys that may or may not be specific to the aerospace and medical industries.

It is a still further aspect of the present invention to achieve a biostatic/fungistatic state without the use of traditional biocides and/or fungicides.

It is a still further aspect of the present invention to provide a metalworking formulation that is not aggressive with regard to human membranes or skin.

It is a still further aspect of the present invention that it is easily miscible with water and that both the concentrated formulation and the diluted metal working fluid exhibit exceptional stability.

Further aspects, advantages and areas of applicability will become apparent from the description provided herein. It should be understood that the description and specific examples are intended for purposes of illustration only and are not intended to limit the scope of the present disclosure or claims.

BRIEF DESCRIPTION OF THE DRAWING

The drawing FIGURE is a graph presenting the foam volume in milliliters on the vertical "Y" axis, for three different metalworking solutions during three test cycles extending along the horizontal "X" axis which represents time.

DETAILED DESCRIPTION

The following description is merely exemplary in nature and is not intended to limit the present disclosure, application, or uses.

As stated above, the water soluble metalworking concentrate of the present invention comprises one or more amines, one or more ferrous corrosion inhibitors, one or more phosphate esters, one or more ether carboxylates, a ricinoleic acid condensate, one or more lubricating agents, deionized water and, optionally, one or more non-ferrous corrosion inhibitors.

The following Table 1 presents five different functional compositions A, B, C, D and E of these eight constituents:

TABLE 1

| | A | B | C | D | E |
|---|---|---|---|---|---|
| Amine | 15% | 15% | 15% | 15% | 15% |
| Non-Ferrous corrosion inhibitor | 0.5% | 0.5% | 0.5% | 0% | 0.5% |
| Ferrous corrosion inhibitor | 3% | 3% | 3% | 3% | 3% |
| Phosphate ester | 4% | 4% | 5% | 5% | 0% |
| Ether Carboxylate | 2% | 2% | 2% | 2% | 2% |
| Ricinoleic acid condensate | 5% | 5% | 5% | 6% | 12% |
| Lubricating agent | 10% | 15% | 20% | 10% | 0% |
| Deionized water | Balance | Balance | Balance | Balance | Balance |

The foregoing constituents are present in the recited percentages in five different functional compositions of the metalworking concentrate according to the present invention. In commercial practice, this concentrate is further diluted, preferably with deionized or reverse osmosis water. Additionally, the metalworking concentrate may be diluted with tap water containing up to 80 grains of hardness with no loss of functionality. The precise concentration of the concentrate in solution is not critical although generally a dilute solution of approximately 5% to approximately 10% of the metalworking concentrate and 90% to 95% water is typical.

The concentrate preferably includes deionized water instead of local tap water, the latter of which may be defined as having the following elemental make-up:

TABLE 2

| | | ppm |
|---|---|---|
| Al | 0.20 | (+/−3.00) |
| B | 0.20 | (+/−5.00) |
| Ca | 32.56 | (+/−3.00) |
| Cu | 0.00 | (+/−1.00) |
| Fe | 0.00 | (+/−3.00) |
| K | 2.20 | (+/−3.00) |
| Mg | 1.00 | (+/−5.00) |
| Na | 16.30 | (+/−3.00) |
| P | 0.30 | (+/−3.00) |
| S | 15.60 | (+/−25.00) |
| Si | 1.20 | (+/−5.00) |
| Co | 0.00 | (+/−1.00) |
| Cr | 0.00 | (+/−1.00) |
| Ni | 0.00 | (+/−1.00) |
| Pb | 0.00 | (+/−5.00) |
| Zn | 0.04 | (+/−5.00) |

In contrast to tap water, deionized water is generally defined as having the following elemental make-up:

TABLE 3

| | | ppm |
|---|---|---|
| Al | 0 | (+/−3.00) |
| B | 0.4 | (+/−5.00) |
| Ca | 0.1 | (+/−3.00) |
| Cu | 0.1 | (+/−1.00) |
| Fe | 0 | (+/−3.00) |
| K | 0 | (+/−3.00) |

TABLE 3-continued

| | | ppm |
|---|---|---|
| Mg | 0 | (+/−5.00) |
| Na | 0.4 | (+/−3.00) |
| P | 0 | (+/−3.00) |
| S | 0 | (+/−25.00) |
| Si | 5.7 | (+/−5.00) |
| Co | 0 | (+/−1.00) |
| Cr | 0 | (+/−1.00) |
| Ni | 0 | (+/−1.00) |
| Pb | 0 | (+/−5.00) |
| Zn | 0.2 | (+/−5.00) |

In more detail, in addition to deionized water, the concentrate contains the following classes of constituents or materials: amines, specifically, (I) primary amines with/or without repeating propylene units, amines with or without alcohol groups, tertiary amines with or without ethyl and methyl groups and cyclo amine compounds; (2) optionally, a non-ferrous corrosion inhibitor such as triazole with a toly and/or benzo group; (3) one or more ferrous corrosion inhibitors such as a dibasic acid (C10-C13) or polycarboxylic acid; (4) a phosphate ester; (5) an ether carboxylate with an ethoxylation of 2 to 11 moles of ethylene oxide; (6) a ricinoleic acid condensate; and (7) one or more of the following lubricating agents: estolide—a low molecular weight Group V estolide ester or a high molecular weight Group V estolide ester, maleated soybean oil, modified castor oil maleate or alkoxylated castor oil maleate, alkoxylated vegetable oil polyester, a polymeric surfactant with a viscosity range from 2500 to 3100 mPa·s, a fatty acid derived from rapeseed oil (high erucic acid rapeseed or HEAR) containing unsaturated C14-C18 and C16-C22 with an erucic acid level of >40%, rapeseed oil (high erucic acid rapeseed) with an erucic acid level of >45%, a vegetable oil based nonionic surfactant, a functional protein. i.e., a mixture of gelatin hydrolysate, citric acid, and potassium sorbate, a tall oil fatty acid with 3.0 rosin max., a lubricant that contains: polyphosphoric acids, polymers with isopropanolamine, tall oil and triethanolamine, a lubricant that contains: sodium dodecylbenzene-sulfonate, triethanolamine, solvent-refined heavy paraffinic distillates and a polymeric surfactant, and a lubricant that contains dinonylphenol, ethoxylated, phosphate.

In one preferred embodiment, the formulation of the concentrate is as follows:

TABLE 4

| % | Chemical Name | Constituent |
|---|---|---|
| Balance | Water | Deionized water |
| 2.5 | Poly(oxy(methyl-1,2-ethanediyl)), alpha-hydro-omega-(2-anninomethylethoxy)-, ether with 2-ethyl-2-(hydroxynnethyl)-1,3-propanediol (3:1) | Amine |
| 2 | 3-Aminooctan-4-ol | Amine |
| 10 | 2-(N-2-Hydroxyethyl-N-methylannino)ethanol | Amine |
| 0.3 | 1H-Benzotriazole, 4(5)-methyl- | Non-ferrous corrosion inhibitor |
| 0.12 | 1,8-Octanedicarboxylic acid | Ferrous corrosion inhibitor |
| 0.5 | 1,9-Nonanedicarboxylic acid | Ferrous corrosion inhibitor |
| 0.38 | Decamethylenedicarboxylic acid | Ferrous corrosion inhibitor |
| 2 | 6,6',6''-(1,3,5-Triazine-2,4,6-triyltriimino)trihexanoic acid | Ferrous corrosion inhibitor |
| 6 | 9-Octadecenoic Acid, 12-Hydroxy-, (R-(Z))-, Homopolymer | Lubricating agent |
| 3 | Brassica campestris oil | Lubricating agent |

TABLE 4-continued

| % | Chemical Name | Constituent |
|---|---|---|
| 3 | (C14-C18) and (C16-C22)Unsaturated alkyl carboxylic acid | Lubricating agent |
| 3 | Poly(oxy-1,2-ethanediyl), alpha-(9Z)-9-octadecen-1-yl-omega-hydroxy-, phosphate | Phosphate ester |
| 1.7 | Phosphoric acid, 2-ethylhexyl ester | Phosphate ester |
| 2 | (Z)-alpha-(Carboxymethyl)-omega-(9-octadecenyloxy)-poly(oxy-1,2-ethanediyl) | Ether carboxylate |
| 5 | 9-Octadecenoic acid, 12-hydroxy-, (9Z,12R)-, homopolymer | Ricinoleic acid condensate |
| 3 | N-cyclohexylcyclohexanamine | Amine |
| 0.1 | Organosiloxane polymer, polyethylene-polypropylene glycol | Defoanner |

Features and Performance of the Concentrate

A first advantage of the metalworking concentrate is that it provides the desired level of lubricity to process metals with different levels of machinability and hardness. The ease with which a given material is processed with a cutting tool referred to as machinability. Machinability is a function of many parameters, including the particular cutting or machining operation, the speed of cutting, the type and composition of the cutting tool and, from the point of view of this invention, the hardness of the substrate and its interaction with the metalworking fluid. These and other factors are combined into a machinability rating (MR), which is a scale that has been derived relative to the machinability of 160 Brinell hardness 8112 cold drawn steel machined at 180 surface feet per minute. This condition is assigned a machinability rating of 1.00. All other materials are rated relative to this scale, with harder to machine materials assigned lower numbers and easier to machine materials assigned higher numbers. The following Table 5 lists some machinability ratings for common alloys:

TABLE 5

| Material | Machinability Rating |
|---|---|
| 702 Inconel | 0.11 |
| Cast Iron (hard) | 0.20 |
| A110 Ti | 0.23 |
| 310 Stainless Steel | 0.30 |
| Chromalloy | 0.50 |
| 410 Stainless Steel | 0.55 |
| 6051T Al | 1.40 |
| 3003 Al | 1.80 |
| Leaded Copper | 2.40 |

The impact of metalworking fluids on the machinability rating is unclear. There are several widely accepted tests which attempt to quantify the degree to which lubrication is imparted to various substrate materials. Standard lubricity wear and extreme pressure tests, such as Pin and V-block evaluation (ASTM D-2760) and the Four Ball Wear (ASTM D 4172) are not suitable for evaluating metal cutting/grinding performance of the metalworking fluids. To establish the advantage that the metal working concentrate of the present invention has in terms of lubricating capability, a lubricity test was performed with a variety of formulations of the present invention and other commercial products.

The field performance of a metalworking fluid considers tool life, surface finish, dimensional control and the stability of the machining process. Metalworking fluids provide lubricity and cooling to improve the metal cutting and grinding performance. At present there is no standard laboratory test available to evaluate the field performance of metalworking fluids during metal cutting and grinding. Standard lubricity wear and extreme pressure tests, such as Pin and V-block evaluation (ASTM D-2760) and the Four Ball Wear (ASTM D 4172) are not suitable for evaluating metal cutting/grinding performance of metalworking fluids as the metal cutting conditions are quite different from the wear tested using the above tests.

It is important to have testing conditions similar to actual metal cutting conditions to evaluate the metalworking fluid performance. Tests such as drilling, reaming and tapping are often used to help the formulation and development work of metalworking fluids. A laboratory scale tapping torque test is often used to evaluate the performance of a metalworking fluid. The tapping torque test is generally simple to perform, fast and consumes a smaller amount of material compared to performing the actual machining test.

A large number of variables can have an impact on measured tapping torque. Such variables include: 1) machine (rigidity, size), 2) material (type of alloy, heat treatment, hardness, thermal properties, etc.), 3) tools (tap and drill size, tap coating, tool material, tool geometry—cutting versus forming taps etc.), 4) method (tapping speed, number of holes tapped per tap, etc.), 5) method of metalworking fluid application (flowing versus stationary), 6) hole geometry (diameter and depth, blind versus open hole), etc. Due to the large number of variables affecting measured tapping torque, it is important to have a testing protocol where a sufficient number of holes are tested for torque and metalworking samples are randomized during testing. It is also important to choose the proper tap size and tap coating to improve the test accuracy. However, this can lead to less correlation with field performance as the tools used during fabrication can be quite different from the tools and coating used during the tapping test.

Results reported below were measured using a CNC machine where the tapping torque as a function of time was measured for each hole tapped. Uncoated forming taps were used for tapping to maximize the impact of lubricity. A metal block with through drilled holes was immersed in a metalworking fluid during tapping. Maximum torque value obtained during tapping a hole was used for analysis. A total number of 28 holes were tapped per fluid. A new tap was used after tapping 7 holes to minimize the impact of tap wear on measured torque. Metalworking fluids were tested in a random order. Since all other parameters except the substrate material and metalworking fluids were held constant, it can be assumed that the measured torque values for a given substrate relates to lubricity and cooling effect of a tested metalworking fluid. Under these conditions, a lower measured torque value indicates better tapping performance.

TABLE 6

| | 316 L Torque Reading |
|---|---|
| Example 1 | 40.8 |
| Example 2 | 42.2 |
| Example 3 | 42.9 |
| Example 4 | 43.1 |
| Example 5 | 44.2 |
| Example 6 | 44.5 |
| Example 7 | 44.5 |
| Example 8 | 45.3 |
| Example 9 | 45.7 |

TABLE 6-continued

| | 316 L Torque Reading |
|---|---|
| Example 10 | 46.2 |
| Example 11 | 48.4 |
| Example 12 | 49.3 |
| Example 13 | 49.4 |
| Example 14 | 49.4 |
| Example 15 | 51.8 |
| Example 16 | 47.3 |
| Example 17 | 43.0 |
| Competitor A | 53.3 |
| Internal Reference Standard | 58.7 |
| Competitor B | 60.4 |
| Competitor C | 62.2 |
| Competitor D | 62.4 |
| Competitor E | 62.8 |
| Competitor F | 65.4 |

Example 1 is a metalworking fluid that contains the lubricity additives of polymeric surfactant with a viscosity range from 2500 to 3100 mPa·s and modified castor oil maleate or alkoxylated castor oil maleate.

Example 2 is a metalworking fluid that contains the lubricity additive package of: functional protein—mixture of gelatin hydrolysate, citric acid, and potassium sorbate, tall oil fatty acid with 3.0 rosin max., rapeseed oil (high erucic acid rapeseed, HEAR) with an erucic acid level of >45% and lubricant that contains: sodium dodecylbenzenesulfonate, triethanolamine, and solvent-refined heavy paraffinic distillates.

Example 3 is a metalworking fluid that contains the lubricity additive package of: functional protein—mixture of gelatin hydrolysate, citric acid, and potassium sorbate, tall oil fatty acid with 3.0 rosin max, rapeseed oil (high erucic acid rapeseed, HEAR) with an erucic acid level of >45% and lubricant that contains: polyphosphoric acids, polymers with isopropanolamine, tall oil and triethanolamine.

Example 4 is a metalworking fluid that contains the lubricity additive package of: functional protein—mixture of gelatin hydrolysate, citric acid, and potassium sorbate.

Example 5 is a metalworking fluid that contains the lubricity additive package of: estolide—high molecular weight Group V estolide ester, modified castor oil maleate or alkoxylated castor oil maleate and alkoxylated vegetable oil polyester.

Example 6 is a metalworking fluid that contains the lubricity additive package of: polymeric surfactant with a viscosity range from 2500 to 3100 mPa·s, fatty acid derived from rapeseed oil (high erucic acid rapeseed, HEAR) containing unsaturated C14-C18 and C16-C22 with an erucic acid level of >40% and rapeseed oil (high erucic acid rapeseed, HEAR) with an erucic acid level of >45%.

Example 7 is a metalworking fluid that contains the lubricity additive package of: polymeric surfactant with a viscosity range from 2500 to 3100 mPa·s, fatty acid derived from rapeseed oil (high erucic acid rapeseed, HEAR) containing unsaturated C14-C18 and C16-C22 with an erucic acid level of >40% and rapeseed oil (high erucic acid rapeseed, HEAR) with an erucic acid level of >45%.

Example 8 is a metalworking fluid that contains the lubricity additive package of: polymeric surfactant with a viscosity range from 2500 to 3100 mPa·s and modified castor oil maleate or alkoxylated castor oil maleate.

Example 9 is a metalworking fluid that contains the lubricity additive package of: estolide—high molecular weight Group V estolide ester and modified castor oil maleate or alkoxylated castor oil maleate.

Example 10 is a metalworking fluid that contains the lubricity additive package of: polymeric surfactant with a viscosity range from 2500 to 3100 mPa·s and modified castor oil maleate or alkoxylated castor oil maleate.

Example 11 is a metalworking fluid that contains the lubricity additive package of: fatty acid derived from rapeseed oil (high erucic acid rapeseed, HEAR) containing unsaturated C14-C18 and C16-C22 with an erucic acid level of >40% and rapeseed oil (high erucic acid rapeseed, HEAR) with an erucic acid level of >45%.

Example 12 is a metalworking fluid that contains the lubricity additive package of: lubricant that contains: sodium dodecylbenzenesulfonate, triethanolamine, and solvent-refined heavy paraffinic distillates and modified castor oil maleate or alkoxylated castor oil maleate.

Example 13 a metalworking fluid that contains the lubricity additive package of: estolide—high molecular weight Group V estolide ester and maleated soybean oil.

Example 14 is a metalworking fluid that contains the lubricity additive package of: lubricant that contains: polyphosphoric acids, polymers with isopropanolamine, tall oil and triethanolamine and modified castor oil maleate or alkoxylated castor oil maleate.

Example 15 is a metalworking fluid that contains the lubricity additive package of: estolide—high molecular weight Group V estolide ester and modified castor oil maleate or alkoxylated castor oil maleate.

Example 16 is a metalworking fluid that contains the lubricity additive package of: estolide—low molecular weight Group V estolide ester and modified castor oil maleate or alkoxylated castor oil maleate.

Example 17 is a metalworking fluid that contains the lubricity additive package of: fatty acid derived from rapeseed oil (high erucic acid rapeseed, HEAR) containing unsaturated C14-C18 and C16-C22 with an erucic acid level of >40%, rapeseed oil (high erucic acid rapeseed, HEAR) with an erucic acid level of >45% and 9-Octadecenioc Acid, 12-Hydroxy-, (R—(Z))—, Homopolymer.

Due to environmental and worker safety concerns, it is highly desirable that certain specific materials or classes of materials not be present in the metalworking concentrate. The ability to achieve appropriate long-term functionality without incorporating the following materials is key both from the point of view of user friendliness and global environmental compliance.

The concentrate of the present invention is made without the use of boron or any boron containing compound. Boron and boron-containing materials are typically used to promote biostatic and fungistatic properties. Boron-containing materials are frequently prescribed (most typically in the form of boric acid).

The concentrate is made without the use of chlorine or any chlorine containing compound. Chlorine-containing paraffinic and olefinic materials are most frequently used to impart lubricity at high temperatures and pressures.

The concentrate is made without the use of sulfur or any sulfur containing compound. Sulfur-containing materials are most frequently used to impart lubricity at high temperatures and pressures.

The concentrate is made without the use of paraffin base oil, either Group I or Group II oils. Paraffinic base oils of varying viscosities are typically used to impart lubricity.

The concentrate is made without the use of naphthenic base oil. Naphthenic based oils of varying viscosities are typically used to impart lubricity.

The concentrate is made without the use of formaldehyde or formaldehyde-releasing agents.

The concentrate is made without the use of registered biocides or fungicides.

Performance of the metalworking fluid relative to foam control is also a critical operational characteristic. Metalworking fluids that provide lower levels of foam allow the continuous processing of parts without stopping the machine to allow the foam to dissipate. Metalworking fluids that provide low levels of foam deliver lubricating fluid to the point of cut more efficiently than are intrinsically foamier products. Low foam generation also allows the machine to run at higher speeds to produce more parts.

Testing of this characteristic is done using a commercially available device to measure the generation and decay of foam in fluids. The standard industry foam tests, ASTM D3519 and IP312, do not provide consistent and/or differentiating data. In order to develop fluids of low foam profile a method that better simulates the conditions that a metalworking fluid experiences in the field is necessary. There are multiple variables that contribute to foam generation or the lack thereof: 1) hardness of water, 2) temperature of the testing fluid, 3) the amount of work (energy) put into the fluid, 4) the type of antifoam additive used in the fluid, and 5) the specific raw materials that are used to develop the metalworking fluid formulation. Due to these variables, it is important to have a protocol that controls many if not all of them.

The results reported here are foam generation and foam decay heights, as measured in milliliters. Water hardness was controlled by using deionized water with an elemental profile of:

TABLE 7

| | | ppm |
|---|---|---|
| Al | 0 | (+/−3.00) |
| B | 0.2 | (+/−5.00) |
| Ca | 0.11 | (+/−3.00) |
| Cu | 0 | (+/−1.00) |
| Fe | 0 | (+/−3.00) |
| K | 0 | (+/−3.00) |
| Mg | 0.5 | (+/−5.00) |
| Na | 0.4 | (+/−3.00) |
| P | 0 | (+/−3.00) |
| S | 0 | (+/−25.00) |
| Si | 0.1 | (+/−5.00) |
| Co | 0 | (+/−1.00) |
| Cr | 0 | (+/−1.00) |
| Ni | 0 | (+/−1.00) |
| Pb | 0 | (+/−5.00) |
| Zn | 0 | (+/−5.00) |

This allowed for the metalworking fluid itself to be evaluated instead of the metalworking fluid and any chemical reactions that may occur when using water of that contains any hardness. The temperature of the testing fluid was maintained at 20° C. The amount of work put into each fluid was maintained as constant for each fluid tested.

TABLE 8

| | | Internal Reference Standard | | | Competitor Product A | | | Example 1 | | |
|---|---|---|---|---|---|---|---|---|---|---|
| | | Cycle 1 | Cycle 2 | Cycle 3 | Cycle 1 | Cycle 2 | Cycle 3 | Cycle 1 | Cycle 2 | Cycle 3 |
| Foam Generation (number of cycles, foam height) | 1 | 0 | 8 | 24 | 0 | 0 | 0 | 0 | 4 | 4 |
| | 2 | 72 | 583 | 642 | 56 | 541 | 555 | 194 | 281 | 308 |
| | 3 | 71 | 586 | 661 | 62 | 576 | 592 | 222 | 283 | 318 |
| | 4 | 81 | 593 | 657 | 94 | 570 | 583 | 220 | 294 | 321 |
| | 5 | 94 | 606 | 661 | 139 | 577 | 589 | 224 | 300 | 316 |
| | 6 | 125 | 590 | 657 | 157 | 578 | 591 | 230 | 294 | 314 |
| | 7 | 142 | 599 | 658 | 234 | 570 | 589 | 241 | 303 | 317 |
| | 8 | 170 | 597 | 665 | 276 | 584 | 590 | 235 | 294 | 311 |
| | 9 | 251 | 613 | 665 | 306 | 584 | 589 | 239 | 299 | 319 |
| | 10 | 286 | 615 | 674 | 340 | 579 | 590 | 237 | 301 | 318 |
| | 11 | 296 | 604 | 667 | 406 | 584 | 599 | 234 | 299 | 316 |
| | 12 | 355 | 612 | 672 | 393 | 584 | 586 | 249 | 303 | 313 |
| | 13 | 383 | 609 | 673 | 436 | 584 | 599 | 249 | 306 | 311 |
| | 14 | 414 | 633 | 665 | 426 | 584 | 593 | 248 | 302 | 321 |
| | 15 | 425 | 620 | 665 | 454 | 584 | 587 | 255 | 301 | 319 |
| | 16 | 459 | 630 | 671 | 484 | 594 | 596 | 252 | 308 | 318 |
| | 17 | 457 | 632 | 672 | 499 | 591 | 598 | 258 | 309 | 319 |
| | 18 | 463 | 632 | 670 | 494 | 586 | 583 | 268 | 311 | 324 |
| | 19 | 484 | 642 | 673 | 510 | 585 | 582 | 264 | 299 | 316 |
| | 20 | 487 | 639 | 674 | 517 | 589 | 592 | 273 | 308 | 326 |
| | 21 | 523 | 634 | 676 | 521 | 594 | 591 | 272 | 311 | 336 |
| | 22 | 494 | 644 | 679 | 531 | 583 | 591 | 273 | 314 | 327 |
| | 23 | 535 | 640 | 679 | 544 | 592 | 597 | 289 | 309 | 323 |
| | 24 | 537 | 642 | 672 | 540 | 587 | 593 | 284 | 311 | 325 |
| | 25 | 539 | 648 | 677 | 551 | 589 | 594 | 284 | 308 | 326 |
| | 26 | 548 | 643 | 677 | 560 | 580 | 591 | 289 | 311 | 328 |
| | 27 | 553 | 655 | 670 | 558 | 588 | 592 | 279 | 314 | 324 |
| | 28 | 549 | 648 | 679 | 561 | 590 | 600 | 288 | 316 | 334 |
| | 29 | 560 | 654 | 673 | 568 | 588 | 579 | 299 | 316 | 329 |
| | 30 | 582 | 655 | 680 | 567 | 591 | 592 | 276 | 311 | 329 |
| | 31 | 570 | 652 | 677 | 568 | 582 | 583 | 293 | 319 | 329 |
| Foam Decay (minutes, ml foam height) | 0:00 | 570 | 652 | 677 | 568 | 582 | 583 | 293 | 319 | 329 |
| | 0:30 | 29 | 341 | 594 | 175 | 491 | 502 | 7 | 16 | 45 |
| | 1:00 | 21 | 120 | 486 | 22 | 384 | 428 | 4 | 4 | 10 |
| | 1:30 | 17 | 38 | 374 | 0 | 303 | 356 | 4 | 4 | 4 |
| | 2:00 | 16 | 33 | 263 | 0 | 198 | 289 | 4 | 4 | 3 |
| | 2:30 | 12 | 29 | 158 | 0 | 112 | 216 | 4 | 4 | 3 |
| | 3:00 | 12 | 27 | 63 | 0 | 21 | 154 | 4 | 4 | 3 |

In the drawing, the graph illustrates foam generation and decay of the three metalworking fluids appearing in the above Table 8 during three test cycles. The upper line A presents the performance of the Applicant's Internal Reference Standard; the middle line B presents the performance of Competitor Product A and the lower line presents the performance of Example 1, the metalworking fluid of the present invention.

The results from Table 8 and the graph show that the foam generation of the Example 1 sample is nearly two thirds (66%) lower than that of the Competitor's Product A and that of the Internal Reference Standard. The foam decay time did not differentiate itself until the end of the third cycle. At this point, the metal working fluid based on the concentrate of the present invention had a decay rate similar to cycle one and cycle two; where the foam level dissipated to zero milliliters of foam. The Reference Internal Standard and the competitor's product both failed to reach zero milliliters of foam height. The rate of decay for each product was also slower from the first two cycles as well. The Example 1, above, used a combination of phosphate esters, ether carboxylates and an organosiloxane polymer to produce the low foam profile.

Emulsion stability or the ability of the metalworking fluid to maintain a homogenous appearance without losing functionality is one of the general characteristics a metalworking fluid should exhibit. A metalworking fluid should be able to withstand the introduction of hard water ions (calcium and magnesium) without splitting of the fluid or causing the fluid to lose any of its performance. To study the emulsion stability of the metalworking fluid the concentrate was diluted into various concentrations of water hardness. The different water samples were made using calcium chloride dehydrate and magnesium chloride hexahydrate. The dilutions of the metalworking fluid concentrate were measured for refractive index and then were exposed to a temperature of 50° C. for 15 hours. They were then re-tested using a digital refractive index device (initial measurement versus after measurement). A large change in refractive index indicates poor emulsion stability.

TABLE 9

| | Example 1 Change in Refractive Index | Competitor A Change in Refractive Index |
|---|---|---|
| DI | 0 | 0 |
| 10 grain | 0 | 0.1 |
| 20 grain | 0 | 0.1 |
| 30 grain | 0.1 | 0 |
| 40 grain | 0 | 0.1 |
| 50 grain | −0.3 | −3.1 |
| 60 grain | −0.4 | −2.1 |
| 70 grain | 0.2 | −9.3 |
| 80 grain | 0.1 | −2.3 |
| 90 grain | 0.2 | −1.5 |
| 100 grain | 0.2 | 2.2 |
| 110 grain | 0.2 | 3.7 |

Another method that was used to determine emulsion stability was the use of particle sizing. A Mastersizer 3000 was used to determine the size of the emulsion droplets and how they changed over time. Mastersizer 3000 is a trademark of Malvern Panalytical of Malvem, U.K.

TABLE 10

| | Particle Size (Volume Density %) | | |
|---|---|---|---|
| | Dx 10 μm | Dx 50 μm | Dx 90 μm |
| Example 1-Day 1 | 0.0668 | 0.122 | 0.212 |
| Example 1-Day 2 | 0.0623 | 0.13 | 0.973 |
| Example 1-Day 3 | 0.0595 | 0.125 | 0.892 |
| Example 1-Day 4 | 0.0601 | 0.125 | 0.348 |
| Competitor 1-Day 1 | 0.135 | 5.27 | 37.4 |
| Competitor 1-Day 2 | 0.139 | 5.69 | 48.7 |
| Competitor 1-Day 3 | 0.138 | 5.65 | 53.7 |
| Competitor 1-Day 4 | 0.246 | 173 | 1070 |
| Competitor 2-Day 1 | 0.0164 | 0.0387 | 0.158 |
| Competitor 2-Day 2 | 0.0207 | 219 | 1210 |
| Competitor 2-Day 3 | 0.023 | 226 | 1220 |
| Competitor 2-Day 4 | 0.0252 | 218 | 1190 |
| Competitor 3-Day 1 | 0.062 | 0.122 | 0.241 |
| Competitor 3-Day 2 | 0.0634 | 0.129 | 72.4 |
| Competitor 3-Day 3 | 0.0653 | 0.137 | 87.8 |
| Competitor 3-Day 4 | 0.0645 | 0.134 | 117 |
| Example 2-Day 1 | 0.0706 | 0.14 | 0.276 |
| Example 2-Day 2 | 0.071 | 0.14 | 0.272 |
| Example 2-Day 3 | 0.0711 | 0.14 | 0.282 |
| Example 2-Day 4 | 0.0729 | 0.148 | 0.381 |

Standard Deviation for all results is +/− 0.06%

The results from Table 10 show that Examples 1 and 2 of the metal working fluid of the present invention did not have a significant statistical difference in the volume density percentage increase over a four day period. The metal working fluids of competitors 1, 2 and 3 do have a statistical difference in the volume density percentage over the same time. The increase in volume density percentage indicates an emulsion that is becoming unstable.

Residue of a metal working solution left behind on components, which can also be referred to as carry-off or drag-out, is also an important property because it indicates how much replenishment the solution will need to maintain its performance and integrity. Carry-off that is low allows the working solution to operate longer without the need to add additional fluid. Current metalworking fluids have a higher carry-off than the metal working fluid of the present invention, resulting in higher fluid consumption and decreased overall performance. These difficulties necessitate the addition of metalworking fluid to the working solution to maintain its performance level.

The performance of a metalworking fluid in operation is dependent upon the fluid being able to maintain its integrity. One of the ways that the integrity of the fluid can fail is via bacterial and/or fungal growth. Once the fluid is overwhelmed with bacteria or fungus, critical components of the fluid, such as pH, corrosion inhibition, emulsion stability, etc. can begin to fail and the metalworking fluid will not operate as it should. Metalworking fluids have traditionally relied upon the use of registered biocides and fungicides to control the growth of these unwanted microbials. Another method of bacterial and/or fungal control involves the use of boron-containing materials such as boric acid. Standard ASTM tests that measure the biostatic and fungistatic control of a metalworking fluid are typically lengthy and have shown irregular reproducibility. The Applicant has developed a proprietary test method that demonstrates good reproducibility and which can be done relatively quickly.

The Bacterial Score and Fungal Score presented in Table 11 is determined using a proprietary broth micro dilution assay. The lower scores indicate that the metalworking fluid will be more resistant to bacterial and/or fungal growth. The bacterium that was used in the test is a strain of *Pseudomonas* that is typically found in metalworking fluids in the field.

The fungus that was used is a strain of *Fusarium* that is typically found in metalworking fluids in commercial applications.

TABLE 11

| | Bacterial Score |
|---|---|
| Competitor A | 101 |
| Competitor B | 123 |
| Competitor C | 101 |
| Internal Reference Standard A | 28 |
| Internal Reference Standard B | 30 |
| Example 1 | 25 |
| | **Fungal Score** |
| Competitor A | 36 |
| Competitor B | 41 |
| Competitor C | 57 |
| Internal Reference Standard A | 14 |
| Internal Reference Standard B | 69 |
| Example 1 | 57 |

Example 1 shows that in a preferred embodiment of the present invention, bacterial and fungal growth is well-controlled without the use of problematic materials.

The machining of ferrous materials with any metalworking fluid requires that the fluid contain some type of corrosion protection so that the part does not corrode before the next process. Additionally, to assure that the machine itself does not corrode during the normal operation, the metalworking fluid must contain materials that protect against corrosion. To test that the metalworking fluid has corrosion protection and to indirectly determine how much relative protection a fluid has, standard IP 287 is done. Due to the composition of the water used in the test being critical the following synthetic water was made having the following composition:

TABLE 12

| | ppm | |
|---|---|---|
| Al | 0 | (+/−3.00) |
| B | 0.2 | (+/−5.00) |
| Ca | 83.88 | (+/−3.00) |
| Cu | 0 | (+/−1.00) |
| Fe | 0 | (+/−3.00) |
| K | 0 | (+/−3.00) |
| Mg | 0.5 | (+/−5.00) |
| Na | 0.4 | (+/−3.00) |
| P | 0 | (+/−3.00) |
| S | 69.2 | (+/−25.00) |
| Si | 0.1 | (+/−5.00) |
| Co | 0 | (+/−1.00) |
| Cr | 0 | (+/−1.00) |
| Ni | 0 | (+/−1.00) |
| Pb | 0 | (+/−5.00) |
| Zn | 0 | (+/−5.00) |

Dilutions of the metalworking fluid embodied as Example 1 were made to the following concentrations: 1%, 1.5%, 2%, 2.5%, 3%, 3.5%, 4%, 5%, 7.5% and 10%. The cast iron chips used were made using ASTM D4627-12 protocol. The evaluation of the corrosion was done by counting the pixels through a commercially available computer program. The count of corroded pixels was compared to the total count of pixels found on the blank test specimen. The rust free point of the fluid was determine to be if the percent corrosion (as determined by the pixel count) was less than or equal to 0.1%.

TABLE 13

| | Rust Free Point |
|---|---|
| Competitor A | 2.50% |
| Competitor B | 7.50% |
| Internal Reference Standard | 3% |
| Example 1 | 1.5% |

Table 13 above shows that the unique combination of primary amines with/or without repeating propylene units, amines with or without alcohol groups, tertiary amines with or without ethyl and methyl groups, cyclo-amine compounds, dibasic acids (C10-C13) and polycarboxylic acid provides an improved ferrous corrosion package as compared to competitor A, competitor B and the Internal Reference Standard.

When machining non-ferrous metals, it is important for the metalworking fluid to provide protection for the metal. The testing of non-ferrous metal compatibility was completed by three different methods. The first method of testing was done using an overnight soak test. The second test was ASTM F483-09. The third test was ASTM F1110-09.

The first test was done using a 10% dilution (made from a stable concentrate) in deionized water. The metals were prepared by first sanding with a Scotch-Brite® pad to remove any oxide layers that had formed and then by rinsing the coupons in isopropyl alcohol and allowing them dry. Scotch-Brite is a registered trademark of the 3M Corporation of St. Paul, Minn. The samples were tested by immersing the sample in 6 milliliters of solution for 15 hours at a temperature of 50° C. The samples were then visually inspected for evidence of corrosion and/or staining. A sample of the immersed fluid was also analyzed by an inductively coupled plasma (ICP) machine to ascertain the amount of dissolved metal. The ASTM F483-09 and ASTM F1110-09 testing were done following each protocol.

The metals that were tested in the first test were: aluminum 3003-H14, aluminum 2024-T3, aluminum 7075-T6, brass CA-260, and copper CA-110. The metals that were tested using the ASTM F483-09 protocol were: aluminum 2024 ALCLAD, aluminum 7075 ALCLAD, aluminum 7075-T6, aluminum 7050, titanium 6Al 4V, and steel 4130. The metals that were tested using the ASTM F1110 protocol were: aluminum 2024 ALCLAD, aluminum 7075 ALCLAD, aluminum 7075-T6, aluminum 2024 that have undergone tartaric acid anodizing (TSA), aluminum 7075 aluminum 2024 that have undergone tartaric acid anodizing (TSA) and titanium 6Al 4V. The results are shown in Tables 14, 15, 16 and 17 respectively.

TABLE 14

| Visual Inspection | | | |
|---|---|---|---|
| | Example 1 | Competitor A | Master Fluids Solution Internal Standard |
| alunninunn 2024-T3 | no stain | no stain | no stain |
| alunninunn 3003-H14 | no stain | no stain | no stain |
| alunninunn 7075-T6 | no stain | no stain | no stain |
| brass CA-260 | no stain | no stain | no stain |
| copper CA-110 | no stain | no stain | no stain |

TABLE 15

| ICP analysis | | | |
|---|---|---|---|
| | Example 1 | Competitor A | Master Fluids Solution Internal Standard |
| aluminum 2024-T3 | Al-<10 ppm | Al-<10 ppm | Al-<10 ppm |
| aluminum 3003-H14 | Al-<10 ppm | Al-<10 ppm | Al-<10 ppm |
| aluminum 7075-16 | Al-<10 ppm | Al-<10 ppm | Al-<10 ppm |
| brass CA-260 | Cu - <10 ppm | Cu -<10 ppm | Cu -<10 ppm |
| | Zn-<10 ppm | Zn-<10 ppm | Zn-<10 ppm |
| copper CA-110 | Cu -< 10 ppm | Cu -< 10 ppm | Cu -< 10 ppm |

The results from the standard overnight test show that none of the products tested stained or leached any metal.

TABLE 16

| ASTM F1110 | | | | |
|---|---|---|---|---|
| Product | Concentration | Metal Alloy | Panel Appearance Before | Panel Appearance After |
| Competitor A | 100% | 2024 Alclad | 0 | 2 |
| Competitor A | 10% | 2024 Alclad | 0 | 1 |
| Competitor A | 100% | 7075 Alclad | 0 | 3 |
| Competitor A | 10% | 7075 Alclad | 0 | 0 |
| Competitor A | 100% | 7075 Bare | 0 | 3 |
| Competitor A | 10% | 7075 Bare | 0 | 4 |
| Competitor A | 100% | Ti | 0 | 1 |
| Competitor A | 10% | Ti | 0 | 1 |
| Competitor A | 100% | 2024 TSA | 0 | 1 |
| Competitor A | 10% | 2024 TSA | 0 | 0 |
| Competitor A | 100% | 7075 TSA | 0 | 2 |
| Competitor A | 10% | 7075 TSA | 0 | 0 |
| Internal Reference Standard | 100% | 2024 Alclad | 0 | 0 |
| Internal Reference Standard | 10% | 2024 Alclad | 0 | 0 |
| Internal Reference Standard | 100% | 7075 Alclad | 0 | 0 |
| Internal Reference Standard | 10% | 7075 Alclad | 0 | 0 |
| Internal Reference Standard | 100% | 7075 Bare | 0 | 1 |
| Internal Reference Standard | 10% | 7075 Bare | 0 | 0 |
| Internal Reference Standard | 100% | Ti | 0 | 0 |
| Internal Reference Standard | 10% | Ti | 0 | 0 |
| Internal Reference Standard | 100% | 2024 TSA | 0 | 0 |
| Internal Reference Standard | 10% | 2024 TSA | 0 | 0 |
| Internal Reference Standard | 100% | 7075 TSA | 0 | 0 |
| Internal Reference Standard | 10% | 7075 TSA | 0 | 0 |
| Example 1 | 100% | 2024 Alclad | 0 | 0 |
| Example 1 | 100% | 7075 Alclad | 0 | 0 |
| Example 1 | 100% | 2024 TSA | 0 | 0 |
| Example 1 | 100% | 7075 TSA | 0 | 0 |
| Example 1 | 100% | Ti | 0 | 0 |
| Example 1 | 100% | 7075 Bare | 0 | 0 |
| Example 1 | 10% | 2024 Alclad | 0 | 0 |
| Example 1 | 10% | 7075 Alclad | 0 | 0 |
| Example 1 | 10% | 2024 TSA | 0 | 0 |
| Example 1 | 10% | 7075 TSA | 0 | 0 |
| Example 1 | 10% | Ti | 0 | 0 |
| Example 1 | 10% | 7075 Bare | 0 | 0 |
| Scoring | 0 | no stain/no difference between before and after | | |
| | 1 | <10% visual difference between before and after | | |
| | 2 | >10%-<50% visual difference between before and after | | |
| | 3 | >50%-<75% visual difference between before and after | | |
| | 4 | >75% visual difference between before and after | | |

The results from the ASTM F1110 show that Example 1 did not stain any of the metals at any concentration. The Internal Reference Standard also did not stain any of the metals. The leading competitive product did stain multiple metals in both the diluted form and concentrated forms.

TABLE 17

| ASTM F483 | | | | | | | |
|---|---|---|---|---|---|---|---|
| Product | Concentration | Metal Alloy | Panel Weight Before | Panel Weight After (168 hrs.) | Panel Weight Loss (mg) | Panel Appearance Before | Panel Appearance After (168 hrs.) |
| Competitor A | 100% | 2024 Alclad | 5.6123 | 5.724 | −0.1117 | 0 | 3 |
| Competitor A | 10% | 2024 Alclad | 5.246 | 5.3546 | −0.1086 | 0 | 2 |
| Competitor A | 100% | 7075 Alclad | 5.267 | 5.3265 | −0.0595 | 0 | 4 |
| Competitor A | 10% | 7075 Alclad | 5.874 | 5.912 | −0.038 | 0 | 3 |
| Competitor A | 100% | 7075 | 5.248 | 5.249 | −1.0000 | 0 | 0 |
| Competitor A | 10% | 7075 | 5.267 | 5.27 | −3.0000 | 0 | 1 |
| Competitor A | 100% | Ti | 10.245 | 10.245 | 0.0000 | 0 | 0 |
| Competitor A | 10% | Ti | 10.567 | 10.566 | 1.0000 | 0 | 0 |
| Competitor A | 100% | Al 7050 | 5.689 | 5.691 | −2.0000 | 0 | 0 |
| Competitor A | 10% | Al 7050 | 5.678 | 5.678 | 0.0000 | 0 | 0 |

TABLE 17-continued

| ASTM F483 | | | | | | | |
|---|---|---|---|---|---|---|---|
| Product | Concentration | Metal Alloy | Panel Weight Before | Panel Weight After (168 hrs.) | Panel Weight Loss (mg) | Panel Appearance Before | Panel Appearance After (168 hrs.) |
| Competitor A | 100% | 4130 | 5.69 | 5.6901 | −0.1000 | 0 | 1 |
| Competitor A | 10% | 4130 | 5.649 | 5.65 | −1.0000 | 0 | 1 |
| Internal Reference Standard | 100% | 2024 Alclad | 5.8053 | 5.8051 | 0.2000 | 0 | 0 |
| Internal Reference Standard | 10% | 2024 Alclad | 5.8093 | 5.809 | 0.3000 | 0 | 1 |
| Internal Reference Standard | 100% | 7075 Alclad | 5.6936 | 5.6936 | 0.0000 | 0 | 1 |
| Internal Reference Standard | 10% | 7075 Alclad | 5.699 | 5.6987 | 0.3000 | 0 | 1 |
| Internal Reference Standard | 100% | 7075 | 5.7652 | 5.7651 | 0.1000 | 0 | 0 |
| Internal Reference Standard | 10% | 7075 | 5.7512 | 5.7511 | 0.1000 | 0 | 1 |
| Internal Reference Standard | 100% | Ti | 10.4444 | 10.4441 | 0.3000 | 0 | 0 |
| Internal Reference Standard | 10% | Ti | 10.3484 | 10.3482 | 0.2000 | 0 | 0 |
| Internal Reference Standard | 100% | Al 7050 | 5.3102 | 5.3103 | −0.1000 | 0 | 0 |
| Internal Reference Standard | 10% | Al 7050 | 5.6293 | 5.6292 | 0.1000 | 0 | 0 |
| Internal Reference Standard | 100% | 4130 | 4.167 | 4.1687 | −1.7000 | 0 | 1 |
| Internal Reference Standard | 10% | 4130 | 4.2457 | 4.2466 | −0.9000 | 0 | 1 |
| Example 1 | 100% | 2024 Alclad | 5.8055 | 5.8054 | 0.1 | 0 | 0 |
| Example 1 | 100% | 7075 Alclad | 5.801 | 5.8011 | −0.1 | 0 | 0 |
| Example 1 | 100% | 7050 | 5.711 | 5.7111 | −0.1 | 0 | 0 |
| Example 1 | 100% | 7075 | 5.6996 | 5.6996 | 0 | 0 | 0 |
| Example 1 | 100% | Ti | 5.7551 | 5.755 | 0.1 | 0 | 0 |
| Example 1 | 100% | 4130 | 5.7498 | 5.7499 | −0.1 | 0 | 0 |
| Example 1 | 10% | 2024 Alclad | 5.645 | 5.6451 | −0.1 | 0 | 0 |
| Example 1 | 10% | 7075 Alclad | 5.6887 | 5.6888 | −0.1 | 0 | 0 |
| Example 1 | 10% | 7050 | 5.6234 | 5.6234 | 0 | 0 | 0 |
| Example 1 | 10% | 7075 | 5.6451 | 5.6452 | −0.1 | 0 | 0 |
| Example 1 | 10% | Ti | 5.6556 | 5.6555 | 0.1 | 0 | 0 |
| Example 1 | 10% | 4130 | 5.7 | 5.6999 | 0.1 | 0 | 0 |

The results from ASTM F483 show that Example 1 and Internal Reference Standard did not stain any metal. The invention and the Internal Reference Standard did not have a weight loss of greater than two milligrams. The leading competitor did stain multiple metals at diluted form and concentrated form. The competitor did have a weight loss of greater than two milligrams on one of the metals.

The unique combination of amines (primary amines with/or without repeating propylene units, amines with or without alcohol groups, tertiary amines with or without ethyl and methyl groups and cylcoamine compounds) combined with the toyl and/or benzo triazole and the phosphate esters provide the present invention with the ability to prevent staining on various aluminum alloys.

The description of the present invention is merely exemplary in nature and variations that do not depart from the gist of the present invention are intended to be, and should be considered to be, within the scope of the present invention. Such variations are not to be regarded as a departure from the spirit and scope thereof, but rather to be regarded as within such spirit and scope.

What is claimed is:

1. A water soluble metalworking concentrate comprising:

A plurality of amines including:

2.5 wt. % Poly(oxy(methyl-1,2-ethanediyl)), alpha-hydro-omega-(2-aminomethylethoxy)-, ether with 2-ethyl-2-(hydroxymethyl)-1,3-propanediol (3:1);

2.0 wt. % 3-Aminooctan-4-ol;

10.0 wt. % 2-(N-2-Hydroxyethyl-Nmethylamino) ethanol; and 3.0 wt. % N-cyclohexylcyclohexanamine;

at least one ferrous corrosion inhibitor;

at least one lubricating agent;

at least one phosphate ester;

at least one ether carboxylate;

a ricinoleic acid condensate; and a balance of water.

2. The water soluble metalworking concentrate of claim 1, wherein the ricinoleic acid condensate comprises 5.0 wt % 9-Octadecenoic acid, 12-hydroxy-, (9Z,12R)-, homopolymer.

3. The water soluble metalworking concentrate of claim 2, wherein the at least one lubricating agents includes:

6.0 wt % 9-Octadecenoic Acid, 12-Hydroxy-, (R—(Z))—, Homopolymer;

3.0 wt % *Brassica* campestris oil; and 3.0 wt % (C14-C18) and (C16-C22) Unsaturated alkyl carboxylic acid.

4. The water soluble metalworking concentrate of claim 3, wherein the at least one phosphate ester comprises:

3.0 wt % Poly(oxy-1,2-ethanediyl), alpha-(9Z)-9-octadecen-1-yl-omega hydroxy-, phosphate; and 1.7 wt % Phosphoric acid, 2-ethylhexyl ester.

5. The water soluble metalworking concentrate of claim 4, wherein the at least one ferrous corrosion inhibitor includes:

0.12 wt % 1,8-Octanedicarboxylic acid;

0.5 wt % 1,9-Nonanedicarboxylic acid;

0.38 wt % Decamethylenedicarboxylic acid; and 2.0 wt % 6,6',6"-(1,3,5-Triazine-2,4,6-triyltriimino)trihexanoic acid.

6. The water soluble metalworking concentrate of claim 5, wherein the at least one ether carboxylate includes 2.0 wt % (Z)-alpha-(Carboxymethyl)-omega-(9-octadecenyloxy)-poly(oxy-1,2-ethanediyl).

7. The water soluble metalworking concentrate of claim 6, further comprising a non-ferrous corrosion inhibitor including 0.3 wt % 1H-Benzotriazole, 4(5)-methyl-.

8. The water soluble metalworking concentrate of claim 6, further comprising a defoamer including 0.1 wt % Organosiloxane polymer, polyethylene-polypropylene glycol.

9. The water soluble metalworking concentrate of claim 6, further comprising substantially free of chlorine, chlorine containing compounds, sulfur, sulfur containing compounds, boron, and boron containing compounds.

* * * * *